US010226143B1

(12) United States Patent
Oser et al.

(10) Patent No.: US 10,226,143 B1
(45) Date of Patent: Mar. 12, 2019

(54) UTENSIL REST

(71) Applicant: Gregory R. Oser, Uniontown, OH (US)

(72) Inventors: Gregory R. Oser, Uniontown, OH (US); William R. Oser, Uniontown, OH (US); Nancy L. Oser, Uniontown, OH (US)

(73) Assignee: Gregory R. Oser, Uniontown, OH (US)

( * ) Notice: Subject to any disclaimer, the term of this patent is extended or adjusted under 35 U.S.C. 154(b) by 0 days.

(21) Appl. No.: 15/665,985

(22) Filed: Aug. 1, 2017

(51) Int. Cl.
*A47G 21/14* (2006.01)

(52) U.S. Cl.
CPC ..... *A47G 21/14* (2013.01)

(58) Field of Classification Search
CPC . A47G 21/14; A47G 21/145; A47F 2001/103; A47J 47/16; B65D 85/1036; B65D 25/02
USPC ..... 248/37.3; 211/70.7; 206/763, 362.4, 206/273, 784
See application file for complete search history.

(56) References Cited

U.S. PATENT DOCUMENTS 1,647,154 A 11/1927 Soybel
2,267,378 A * 12/1941 Snelling ..... A47F 5/112 211/195
2,639,081 A 5/1953 Metzger
2,651,927 A 9/1953 Mullins
2,930,558 A 3/1960 Bugay
3,013,668 A 12/1961 Mennen
3,263,820 A 8/1966 McFadden et al.
3,297,166 A * 1/1967 Summers ..... A47J 37/0694 211/60.1
3,915,213 A 10/1975 Graham, Jr.
4,573,570 A * 3/1986 Cortopassi ..... A47G 19/30 229/938
D292,861 S 11/1987 Dorper
4,770,379 A 8/1988 Estvold
4,834,328 A 5/1989 Hall
4,858,863 A 8/1989 Lin
4,893,768 A * 1/1990 Hall ..... A47G 21/14 211/70.7
4,940,199 A 7/1990 Hall
5,411,141 A 5/1995 Bounds
D360,560 S 7/1995 Stroecker
D378,564 S * 3/1997 Hall ..... D7/637
5,842,633 A 12/1998 Nurse
D423,303 S 4/2000 Morton et al.
6,269,961 B1 8/2001 Porcelli
6,604,714 B1 8/2003 Hall
6,994,304 B2 2/2006 Kim et al.
7,347,326 B2 * 3/2008 Baechle ..... B65D 5/009 206/453
D579,278 S 10/2008 Umnitz
D658,452 S 5/2012 Elattrache
8,668,171 B2 3/2014 Tarantino et al.
D715,601 S 10/2014 Elattrache
D723,875 S 3/2015 Elattrache
2013/0087664 A1 4/2013 Weavel

* cited by examiner

*Primary Examiner* — Christopher Garft
(74) *Attorney, Agent, or Firm* — Vorys, Sater, Seymour and Pease LLP; Mark A. Watkins, Esq.

(57) ABSTRACT

This invention relates to a means of elevating utensils from an eating surface. The utensil rest is readily and easily assembled and remains in a constructed configuration during use that is not prone to collapse and is suitable for supporting utensils.

14 Claims, 4 Drawing Sheets

UTENSIL REST

BACKGROUND

It is often undesirable to have direct contact between utensils and eating surfaces. Contact between utensils and the eating surface may cause bacteria, viruses or other contaminants on the eating surface to be transferred to the utensil, where they could be conveyed to the mouth and potentially cause temporary sickness, disease or loss of appetite. Additionally, used utensils placed directly on the eating surface may dirty the surface or cause stains, particularly if the surface is prone to staining such as a porous surface or one covered by a tablecloth or placemat, making the eating environment unpleasing for a dining patron. This may also cause a restaurant purveyor to spend more on napkins, utensils, tablecloths and the like. This may also add to the cost of labor in dealing with the unpleasant conditions and make the situation less appealing and productive. Consequently, elevation of utensils from an eating surface is often desirable.

BRIEF SUMMARY OF THE INVENTION

Referring generally to FIGS. 1-7, the present subject matter discloses embodiments of a utensil rest formed from a band 100. An embodiment comprises a first section 110, a second section 120, a third section 130, a fourth section 140, and a fifth section 150. The sections are separated by four folding lines 119, 129, 139, 149. The band may be folded at the folding lines to form the folded configuration. The first section 110 and fifth section 150 may be connected while in the folded configuration to form a constructed utensil rest, In some embodiments, the connection is facilitated by a first section tab 115 and a fifth section tab 155. The second 120 and fourth 140 sections each comprise one or more corresponding cutlery recesses 122, 142 that are configured to accommodate utensils. Referring to FIG. 8, the utensil rest may optionally have one or more bottom sections 105 and one or more top sections 160.

BRIEF DESCRIPTION OF THE DRAWINGS

Reference is made to the accompanying drawings illustrating embodiments of the invention in which.

Index of Parts

Figure 1:
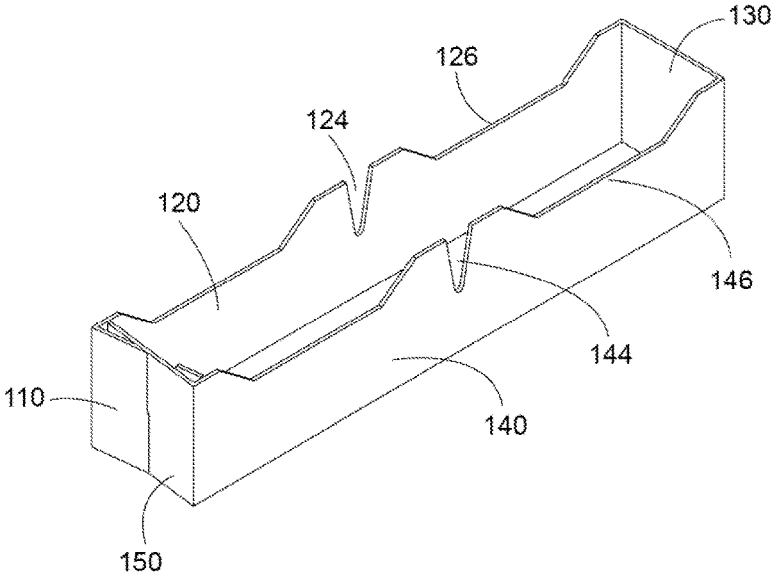
FIG. 1 is a perspective view of a utensil rest with interlocking tabs in a folded configuration.
Figure 2:
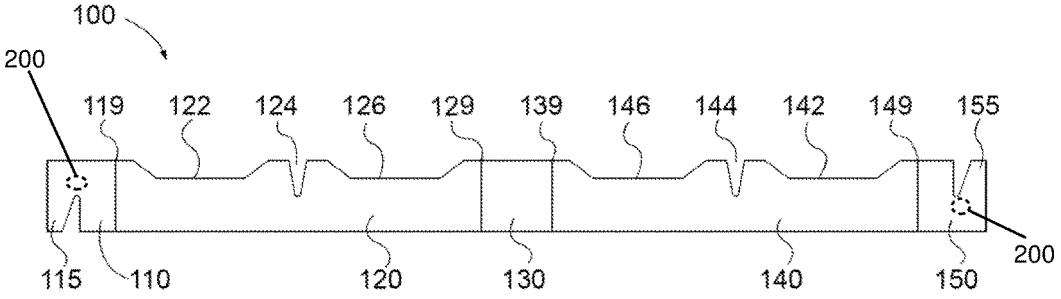
FIG. 2 is a view of a utensil rest with interlocking tabs in an unfolded configuration.
Figure 3:
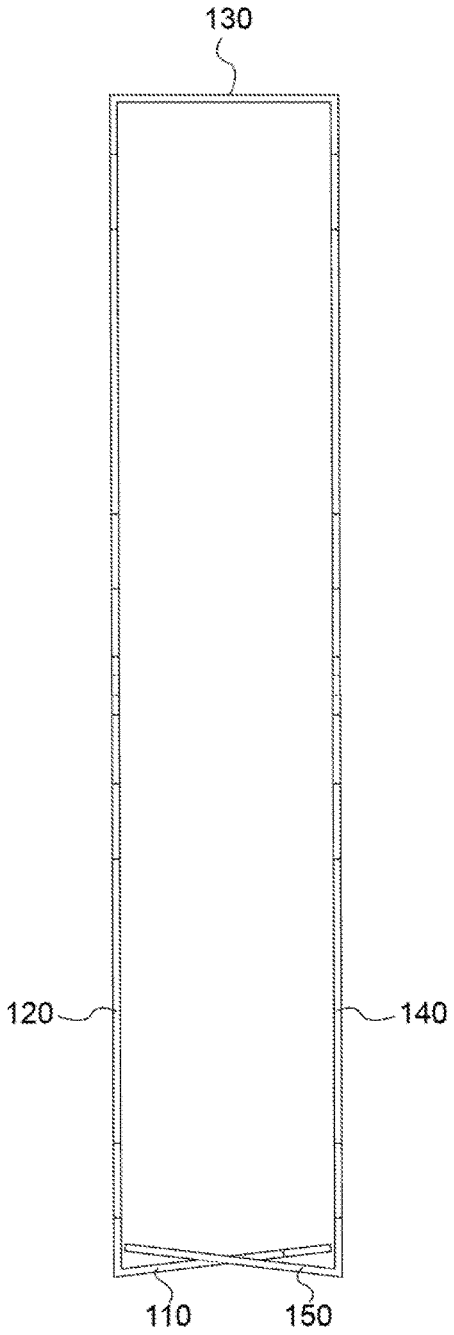
FIG. 3 is a top plain view of the utensil rest shown in FIG. 1.
Figure 4:
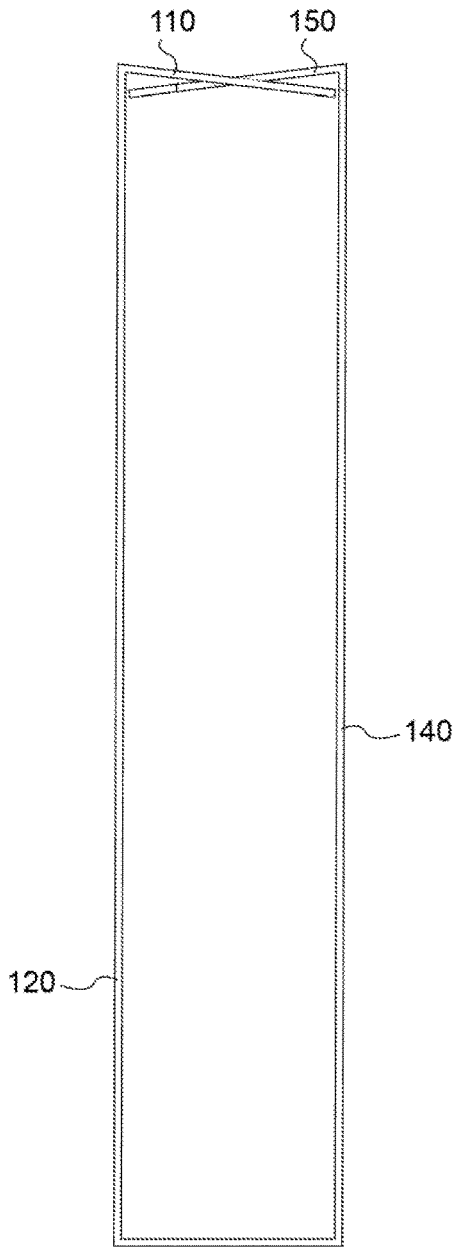
FIG. 4 is a bottom plain view of the utensil rest shown in FIG. 1.
Figure 5:
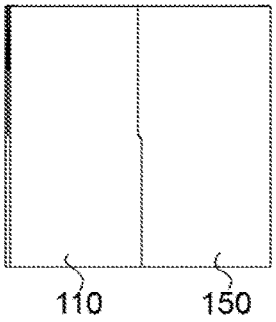
FIG. 5 is an interlocking end view of the utensil rest shown in FIG. 1.
Figure 6:
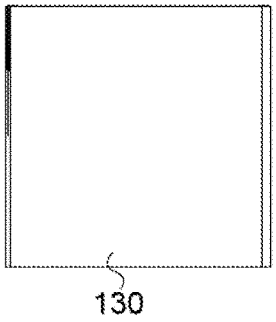
FIG. 6 is a folded end view of the utensil rest shown in FIG. 1.
Figure 7:
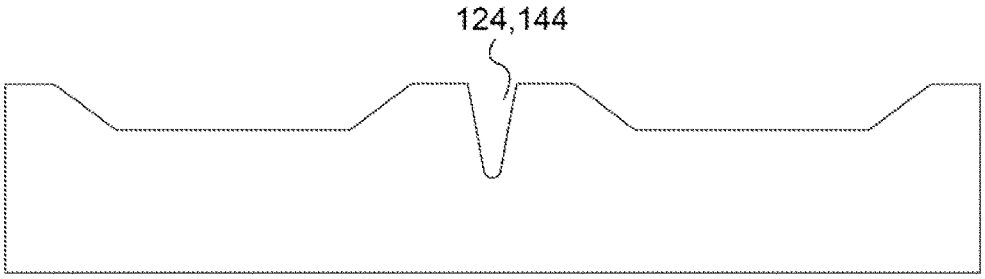
FIG. 7 is a side view of the utensil rest shown in FIG. 1.
Figure 8:
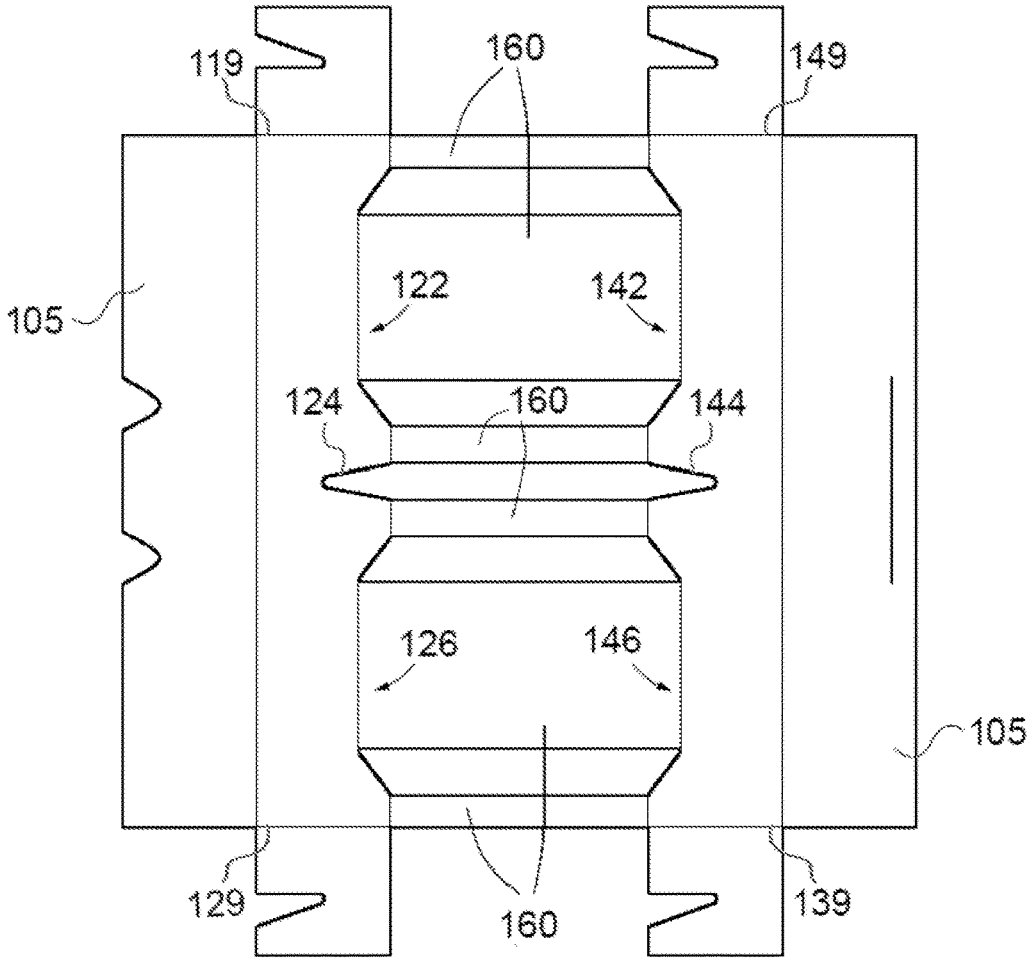
FIG. 8 is a view of a utensil rest with a bottom section and a top section.

The following is an index of the parts shown in FIGS. 1-8:

100. Band
105. Bottom section
110. First section

115. First section tab
119. First fold line
120. Second section
122. First shallow recess of the second section
124. Narrow recess of the second section
126. Second shallow recess of the second section
129. Second fold line
130. Third section
139. Third fold line
140. Fourth section
142. Second shallow recess of the fourth section
144. Narrow recess of the fourth section
146. First shallow recess of the fourth section
149. Fourth fold line
150. Fifth section
155. Fifth section tab
160. Top section
200. Joining feature

DETAILED DESCRIPTION OF THE INVENTION

The instant invention relates to a means of elevating utensils from a surface, and more particularly to a utensil rest adapted to elevate utensils from eating surfaces such as a table, counter, tray, or the like. The utensil rest may be readily and easily assembled and remain in a constructed configuration during use that is not prone to collapse and is suitable for supporting utensils.

The utensil rest comprises one or more bands of material which may be formed from any of a variety of plastic, paper board, cardboard, or cellulosic materials known to those skilled in the art. In some embodiments, the one or more bands are comprised of a 100% recyclable material such as clay-coated newsback, clay-coated kraft back or sheeted plastic material.

In some embodiments, the utensil rest is suitable for single use, after which it may be recycled or otherwise disposed. In other embodiments, the utensil rest is suitable for multiple uses.

The one or more bands of material that comprise the utensil rest could be produced individually, or a plurality of bands may be supplied on a die-cut sheet material, or supplied on a roll. In some embodiments, the material is semi-rigid, meaning it is stiff and solid, but not inflexible. The semi-rigid material maintains its own shape under the weight of utensils, and yet is pliable or foldable upon the application of force.

The utensil rest may be formed by folding the one or more bands of material at designated fold lines. The fold lines of the band may be demarcated by scores, indentations, perforations, printed ink or otherwise made visible so that the one or more bands may be folded at each fold line. The band forms the folded configuration when all fold lines are folded. Before the band is folded, or when the band is straightened, the band forms the unfolded configuration.

The ends of the band or the two or more bands may be made to meet using, for example, interlocking tabs or other alternate or complementary features. In some embodiments, the ends of the band or the two or more bands are connected via a joining feature 200, including but not limited to the following glue, adhesive, clips, or by any other means known to one skilled in the art suitable for connecting the ends. When the ends of the one or more bands are connected, the band forms a closed polygon constructed configuration intended to support utensils in a position that is raised from the surface upon which the utensil rest is situated.

The one or more bands of the utensil rest, when in a constructed configuration, create a closed polygon with a top edge, a flat bottom edge, an open interior, and at least one set of parallel sides. The utensil rest has two elongated sides and two short sides. In some embodiments, the flat bottom edge is largely flat to rest flush with the eating surface. In other embodiments, the flat bottom edge may be elliptical, zigzag, scalloped or variously shaped. In some embodiments, the utensil rest is largely rectangular. In another embodiment, the utensil rest is largely trapezoidal. The utensil rest may also optionally be a parallelogram.

The utensil rest has one or more recesses along the top edge of one or more of the elongated sides or short sides. The recesses are configured to accommodate utensils. There could be any number of recesses and any combination of configurations of recesses. In various embodiments, the recesses may be configured to hold one or more eating utensils, or cutlery, such as forks, spoons, knives, chopsticks, skewers, crackers, tongs, picks, cooking or serving utensils, or any combination thereof.

The recesses on the top edge may, in some embodiments, be deep enough to prevent the utensils from falling to the eating surface in the event that the table is bumped, or the utensil rest is otherwise jarred. In some embodiments, the recesses on the top edge do not penetrate farther than 50% of the way through the band in order to maintain structural integrity. In other embodiments, the recesses do not penetrate more than 75% of the band. In some embodiments, penetration of the recesses beyond 75% of the band limits the ability of the utensil rest to accommodate heavy cutlery.

In some embodiments, one or more recesses on one side of the utensil rest has or have a corresponding recess on the opposite side of the utensil rest. These one or more pairs of corresponding recesses may be largely identical, or they may be complementary, or they may be entirely different shapes. In some embodiments, the recess of one of the sides is comparatively deeper than the corresponding, opposing recess in order to accommodate utensils being held at an angle. In other embodiments, corresponding recesses have equal depths.

In some embodiments, two or more of the cutlery recesses are narrow and formed from a rounded tip triangular cut-out of the band, and are configured to accommodate knives, chopsticks, or other narrow utensils. In other or the same embodiments, two or more of the cutlery recesses are shallow and formed from an obtuse trapezoidal cut-out of the band, and are configured to accommodate spoons, forks, or other broader utensils.

The band may have a customized appearance. This may include, without limitation, logos, promotional advertising, images of characters or mascots, symbols, numbers, letters, and other decorative indicia or colors.

By way of a non-limiting example, in some embodiments the band is divided into five sections, denoted as the first, second, third, fourth and fifth sections, by four folding lines, named as the first, second, third and fourth folding lines. Each of the four folding lines is situated in a vertical orientation, perpendicular to the eating surface. The fold lines are perpendicular to the eating surface upon which the band is designed to rest; therefore resting utensils will not stress the fold points and consequently cause collapse of the utensil rest under the weight of heavy utensils.

The ends of the band, alternatively denoted as the first and fifth section or the first and second ends, may be made to meet in order to form the constructed configuration using, for example, interlocking tabs or other complementary features, such as the joining feature 200 which may include glue, adhesive, clips, or by any other means known to one skilled in the art suitable for connecting the ends. The connected first and fifth sections form the interlocking end side of the closed polygon constructed configuration.

The first section of the band is the first end. In various embodiments, the first end may have a tab in an upwards or downwards facing orientation suitable for interlocking with a complimentary tab on the second end, or it may have a tab with an orientation primarily parallel to the eating surface, or it may have a slot, or any other connecting means known to those skilled in the art.

The second section of the band, the second side, is flanked on either end by folding lines. The top edge, farthest from an eating surface, of the second side provides one or more cutlery recesses. The cutlery recesses may be variously shaped to accommodate differently shaped and weighted utensils. In an embodiment, the second side provides two broad, shallow recesses configured to accommodate a spoon and a fork, and a narrow, deep recess configured to accommodate a knife. The recesses of the second side have corresponding cutlery recesses on the fourth side. When the utensil rest is in the constructed configuration, the cutlery recesses of the second and fourth sides are situated opposite from each other to accommodate and support utensils.

The third section of the band, alternatively called the folded end, is flanked by folding lines. The third side opposes the connected first and fifth sections when the band is in the constructed configuration.

The fourth section of the band, the fourth side, is flanked on either end by folding lines. The top edge, farthest from an eating surface, of the fourth side provides one or more cutlery recesses. The cutlery recesses may be variously shaped to accommodate differently shaped and weighted utensils. In an embodiment, the fourth side provides two broad, shallow recesses configured to accommodate a spoon and a fork, and a narrow, deep recess configured to accommodate a knife. The recesses of the fourth side have corresponding cutlery recesses on the second side. When the utensil rest is in the constructed configuration, the cutlery recesses of the second and fourth sides are situated opposite from each other to accommodate and support utensils.

The fifth section of the band is the second end. In various embodiments, the second end is largely rectangular, or it may be largely rectangular with a tab in an upwards or downwards facing orientation suitable for interlocking with a complimentary tab on the first end, or it may have a tab with an orientation primarily parallel to the eating surface, or it may have a slot, or any other interlocking or connecting means known to those skilled in the art. The fifth section connects to the first section.

In one embodiment, the first section and fifth section have interlocking and complimentary tabs that connect the utensil rest in such a way that the weight of utensils causes the tab that is on top, farther from the eating surface, to press more firmly against the tab that is on the bottom, thus forming a stronger connection between the first and fifth sections. In another embodiment, the first or fifth section has a tab configured to be inserted into a slot on the opposing short end, the first or fifth section. Similarly, the weight of utensils causes the tab to be pressed down and firmly rest against the bottom of the slot, strengthening the connection. In another embodiment, the first and fifth sections are glued together. In yet another embodiment, the first or fifth section includes the joining feature 200 such as an adhesive band from which a protective covering may be removed to expose the adhesive and enable the section with the adhesive band to adhere to the opposing end.

In some embodiments with complimentary or interlocking connections, there are signs, indications or distinguishing marks that indicate how the utensil rest should be optimally connected.

In some embodiments, the utensil rest may have a top section or a bottom section or both a top and bottom. The top and bottom sections may be continuous or have a plurality of cut-outs or otherwise be divided, in which case they may optionally be denoted as a plurality of top sections and bottom sections. The top and bottom sections may be used to catch drippings or food falling from the utensils. They also may provide additional space for advertising, branding and other decorative indicia. Further, they may provide additional entertainment by, in some embodiments, requiring one or more folds or one or more connections or both.

The optional bottom section may be, without limitation, continuous, continuous with one or more folding lines, or it may be divided. In embodiments featuring two bottom sections, the bottom sections may interlock or otherwise connect with tabs, a tab and a slot, or any other connecting means known to those skilled in the art.

The optional top section or sections may be continuous or optionally feature one or more cut-outs and one or more folding lines or a combination of both. The folding lines may be used to create one or more sections of the top section that are recessed, or lowered from the top of the one or more elongated side or short sides, to accommodate utensils. Additionally, in embodiments that contain a top portion and sections of the top section that are recessed, a plurality of folds may be used to create a pleat so that any non-recessed portions span the same distance as the recessed portions of the top section.

It will be understood that the embodiments described herein are not limited in their application to the details of the teachings and descriptions set forth, or as illustrated in the accompanying figures. Rather, it will be understood that a utensil rest, as taught and described according to multiple embodiments disclosed herein, is capable of other embodiments and of being practiced or carried out in various ways.

Also, it is to be understood that the phraseology and terminology used herein is for the purpose of description and should not be regarded as limiting. The use herein of "including," "comprising," and variations of those words and similar words is meant to encompass the items listed thereafter, and equivalents of those, as well as additional items.

Accordingly, the descriptions herein are not intended to be exhaustive, nor are they meant to limit the understanding of the embodiments to the precise forms disclosed. It will be understood by those having ordinary skill in the art that modifications and variations of these embodiments are reasonably possible in light of the above teachings and descriptions.

What is claimed is:

1. A utensil rest comprising:

two elongated sides and two short sides, all formed from semi-rigid non-metallic sheet material and creating a closed polygon, the closed polygon defining a top edge, a flat bottom edge and an open interior; the closed polygon having at least one set of parallel sides spaced apart from each other; wherein the top edge defines a top opening and the flat bottom edge defines a bottom opening; and two or more pairs of recesses along the top edge of the elongated sides or short sides configured to accommodate one or more utensils, wherein a first pair of recesses being a narrow triangular shaped cut-out and wherein a second pair of recesses being a shallow obtuse trapezoidal cut-out.

2. The utensil rest as recited in claim 1 wherein at least one elongated side and one short side are formed from a single semi-rigid sheet of material.

3. The utensil rest as recited in claim 1 wherein the two elongated sides and two short sides are formed from a single band of semi-rigid sheet of material.

4. The utensil rest as recited in claim 3 wherein at least one side is formed by sections extending from opposite ends of the single band.

5. The utensil rest as recited in claim 1, wherein at least one of the two short sides includes a first end and a second end that meets the first end to form the closed polygon.

6. The utensil rest as recited in claim 5, wherein the first end comprises a first interlocking tab and the second end comprises a second interlocking tab that is complimentary to the first interlocking tab.

7. The utensil rest as recited in claim 6, wherein the first interlocking tab is upwardly oriented and the second interlocking tab is downwardly oriented.

8. The utensil rest as recited in claim 5, wherein the first end and the second end are connected together via joining feature, the joining feature being selected from the group consisting of an adhesive, a glue, and a clip.

9. The utensil rest as recited in claim 5, wherein the first end comprises a first interlocking tab and the second end comprises a second interlocking tab that is complimentary to the first interlocking tab.

10. The utensil rest as recited in claim 9, wherein the first interlocking tab is upwardly oriented and the second interlocking tab is downwardly oriented.

11. The utensil rest as recited in claim 5, wherein the first end and the second end are connected together via joining feature, the joining feature being selected from the group consisting of an adhesive, a glue, and a clip.

12. The utensil rest as recited in claim 1, wherein the narrow triangular shaped cut-out of the first pair of recesses includes a rounded tip.

13. The utensil rest as recited in claim 1, further comprising a third pair of recesses configured as a shallow obtuse trapezoidal cut-out.

14. The utensil rest as recited in claim 13, wherein the first pair of recesses is situated between the second pair of recesses and the third pair of recesses.

* * * * *